United States Patent [19]

Campbell

[11] 4,066,250

[45] Jan. 3, 1978

[54] SKI CLAMPING APPARATUS

[76] Inventor: James B. Campbell, 5215 Arden, Warren, Mich. 48092

[21] Appl. No.: 748,493

[22] Filed: Dec. 8, 1976

[51] Int. Cl.[2] ..... B25B 1/20

[52] U.S. Cl. ..... 269/43; 269/88; 269/97; 269/166; 269/252; 269/321 W; 269/153

[58] Field of Search ..... 269/43, 88, 296, 321 W, 269/97, 98, 153, 250, 252, 166

[56] References Cited

U.S. PATENT DOCUMENTS

| | | | |
|---|---|---|---|
| 1,659,342 | 2/1928 | Wetzler | 269/166 |
| 2,450,303 | 9/1948 | Susgen | 269/250 |
| 3,854,712 | 12/1974 | McGee | 269/321 W |
| 3,861,664 | 1/1975 | Durkel | 269/43 |

*Primary Examiner*—Al Lawrence Smith

*Assistant Examiner*—Robert C. Watson

*Attorney, Agent, or Firm*—Cullen, Settle, Sloman & Cantor

[57] ABSTRACT

A ski clamping apparatus for holding one or a pair of snow skis while sharpening and waxing the skis. A pair of identical clamps are mounted on a support, such as on a top of a desk or a cabinet, with the clamps spaced apart for supporting the ski or skis at longitudinally spaced areas. Each clamp has a pair of clamping sections, with each section adapted to hold a ski at the longitudinal edges thereof and with the bottom of the ski facing upwardly to permit filing and waxing of the bottom of the ski or adapted to hold a ski while resting on its lower edge, the upper edge of the ski facing upwardly. With such an arrangement the edges of both skis can be sharpened simultaneously by an implement mounted at a predetermined angle to the exposed upper edges.

14 Claims, 6 Drawing Figures

SKI CLAMPING APPARATUS

BACKGROUND OF THE INVENTION

1. Field of the Invention

The invention relates to a ski clamping apparatus for holding one or a pair of snow skis in proper alignment to facilitate filing and waxing.

2. Description of the Prior Art

The use of steel edges on skis has been common for more than thirty years. The desire to dress or hone these edges to maintain their gripping power on icy slopes has increased over the last few years with the great increase in skiing enthisiasm and the resulting deterioration of conditions on the hard-traveled slopes. Sharpening of the steel edges has mostly been performed one at a time, usually held in a common bench vise. Both metal files and abrasive stones have been utilized. A common difficulty has been in maintaining the abrasive instrument at the exact constant angle for sharpening.

Ski sharpening apparatus similar to the one disclosed herein is the subject of my prior U.S. Pat. No. 3,921,967 dated Nov. 25, 1975 and to devices of the prior art patents cited therein. Such patents lack disclosure of structural features and functional attributes of the improvement described herein.

SUMMARY OF THE INVENTION

In accordance with the present invention the ski clamping apparatus consists of a pair of clamps which are adapted to be attached to a support such as the top of a desk or a cabinet. The clamps are aligned and are each provided with a pair of clamping sections. Each clamping section is adapted to hold a ski at the longitudinal edges thereof, with the bottom of the ski facing upwardly; and is adapted to hold one of a pair of skis at a predetermined elevation, with the skis of both clamping sections arranged parallel and resting on the lower edges thereof whereby the upper edges of the skis face upwardly to permit the upper edges of the skis to be sharpened simultaneously.

Each of the ski clamps are mounted on the support by manually operated clamping means. Each of the clamping sections includes means for gripping the skis at longitudinally spaced points, with manually operated means provided for urging and maintaining the abutment surfaces of each clamping section in the required position to hold one or a pair of skis.

A feature of the present invention is to provide a ski clamping apparatus consisting of a pair of clamps which are of simple construction, economical to manufacture, long lasting and relatively trouble-free in operation.

DESCRIPTION OF A PREFERRED EMBODIMENT

Ski clamping apparatus 10 consists of a pair of clamps 12, with each clamp being of identical construction and made from steel. Clamps 12 are relatively small and compact which permit them to be transported in a traveling case, luggage or bag utilized by a skier. Thus it is possible for the ski enthusiast to condition his or her skis at the ski area. Each clamp 12 is adapted to be mounted on a support such as the top panel of a desk or cabinet (with the drawer removed) as represented by the numeral 14 in FIGS. 3 and 6.

Figure 6:
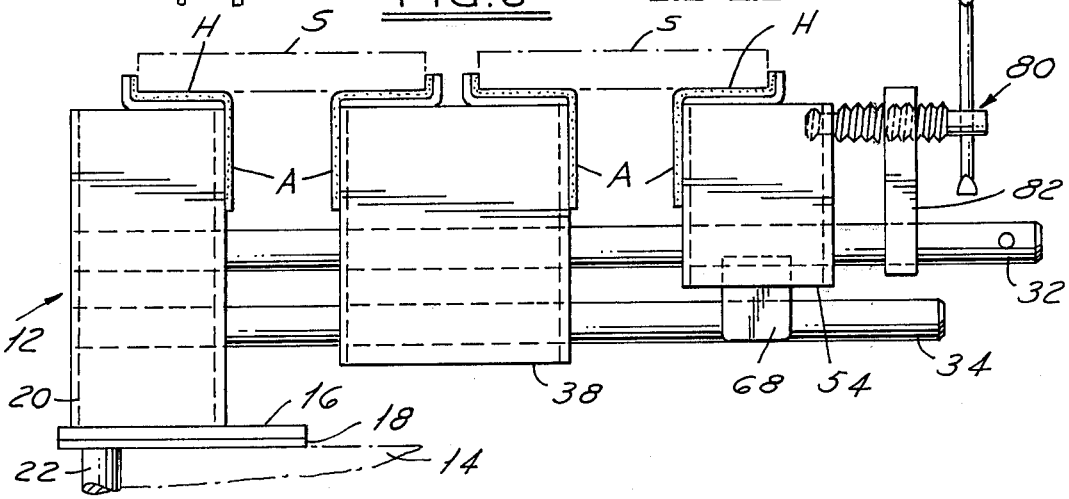
FIG. 6 is a fragmentary elevational view of one of the clamps of the ski clamping apparatus, with the bottom surfaces of the skis facing upwardly.
Figure 3:
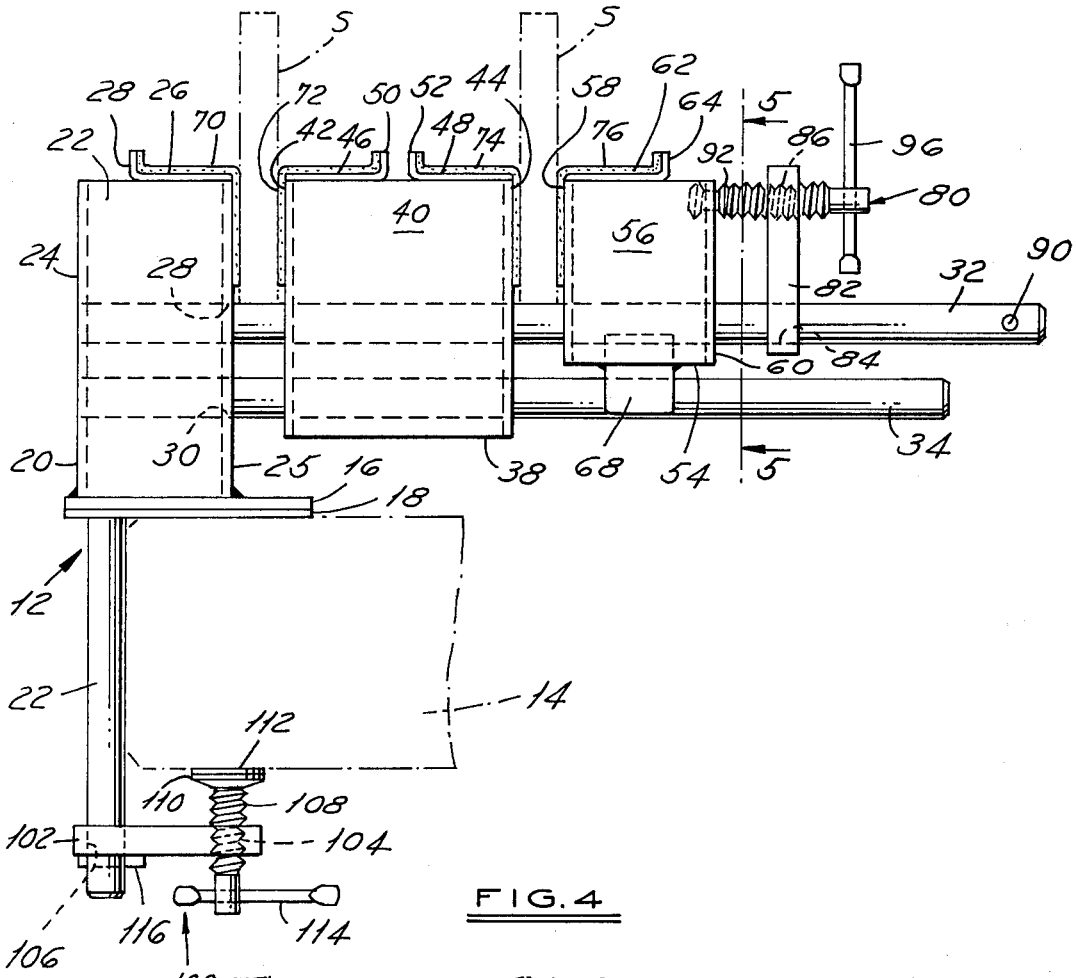
FIG. 3 is a side elevational view of one of the clamps of the ski clamping apparatus, with the skis resting on their longitudinal edges.

Each clamp 12 has a horizontal support flange or base 16, the lower surface of which has secured thereto a resilient pad 18 engageable with the top of support 14 as shown in FIGS. 3 and 6.

The support flange 16 is provided with a stationary clamping member 20 which is welded or secured to the upper surface thereof and with an elongated rod 22 which is secured, as an example, by welding to the lower surface thereof. The stationary clamping member 20 and rod 22 extend from support 16 in opposite vertical directions. The rod 22 is secured to flange 16 adjacent one edge portion thereof.

The clamping member 20 is of tubular or hollow construction and of generally rectangular configuration. It includes a pair of side walls 22, a pair of end walls 24, 25 and a top element 26 for partly closing the upper end of clamping member 20. The top element 26 is welded to clamping member 20 and is provided with an upwardly extending flange 28. The bottom end of clamping member 20 is closed by the support flange 16.

End wall 25 is provided with a pair of vertically spaced circular openings 28 and 30. A pair of elongated mounting elements or cylindrical rods 32 and 34 have end portions which are inserted in openings 28 and 30 respectively and extend through the interior of clamping member 20. Finally such end portions of rods 32 and 34 abut the end wall 24 and are welded to the stationary clamping member 20. The rods 32 and 34 extend from the clamping member 20 in one direction, with the axes thereof parallel and spaced vertically apart. The rods 32 and 34 are solid steel rods of the same diameter.

Each clamp 12 includes a first movable clamping member 38 of tubular or hollow construction and of generally rectangular configuration. The first clamping member 38 is opened at the bottom, includes a pair of side walls 40 and a pair of end walls 42, 44. The first clamping member 38 is also provided with top closing members 46, 48 which have upwardly extending flanges 50 and 52 respectively which are spaced apart. Each end wall 42, 44 is provided with a pair of circular openings so that the first movable clamping member 38 may be non-rotatably and slidably mounted on the rods 32 and 34 as shown in FIGS. 3 and 6.

Clamp 12 is also provided with a second movable clamping member 54 of tubular or hollow construction and of generally rectangular configuration. The second clamping member 54 is opened at the bottom, includes a pair of side walls 56 and a pair of end walls 58 and 60. It also includes a top closing member 62 having an upwardly extending flange 64. End walls 58 and 60 are each provided with a single circular opening so that the second movable clamping member 54 may be slidably and rotatably mounted on the upper mounting element or rod 32. The bottom edge of one side wall 56 of the second clamping member 54 is provided with a depending flange engageable with the lower rod 34 to align the abutments of the clamping sections as will be subsequently described.

Stationary clamping member 20 has a length or height greater than the lengths of the first and second movable clamping members 38 and 54 while the first clamping member has a length or height greater than the length of the second movable clamping member 54 as shown in FIG. 3.

The stationary clamping member 20 and the first movable clamping member 38 are provided with first abutments which cooperate to form a first clamping section for a workpiece or ski S. The first abutment on the stationry clamping member 20 includes the area or surface on top element 26 including flange 28 and the upper part of the end wall 25 to which are secured a resilient pad 70. The first abutment on the first movable clamping member 38 includes the area or surface on top element 46 including flange 50 and the upper part of end wall 42 to which is secured a resilient pad 72. Thus the clamping areas defined by resilient pads 70 and 72 form the first clamping section.

The first and second movable clamping members 38 and 54 are provided with second abutment which cooperate to form a second clamping section for another workpiece or ski S. The second abutment on the first movable clamping member 38 includes the area or surface on top element 48 including flange 52 and the upper part of the end wall 44 to which are secured a resilient pad 74. The second abutment on the second movable clamping member 54 includes the area or surface on top element 62 including flange 64 and the upper part of the end wall 58 to which are secured a resilient pad 76. Thus the clamping areas defined by resilient pads 74 and 76 form the second clamping section.

Figure 4:
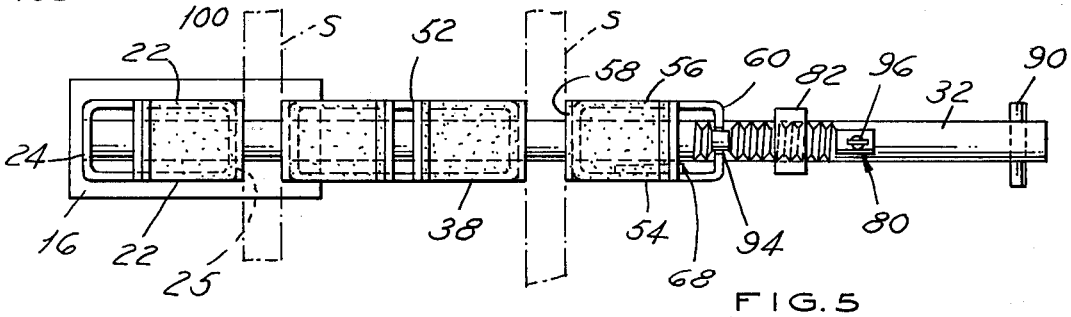
FIG. 4 is a top view, of the clamp shown in FIG. 3.

The clamp 12 includes releasable fastening means 80 carried by the upper mounting element or rod 32 and which is engageable with the second clamping member 54 as shown in FIGS. 3 and 4 for maintaining the workpieces or skis S between the cooperating first and second abutments of the clamping sections. The releasable fastening means 80 includes a locking plate or bracket 82 having a pair of longitudinally spaced openings 84 and 86. Opening 84 is smooth and non-threaded while opening 86 is threaded. The bracket 82 is mounted on rod 32 which extends through the non-threaded opening 84. A stop pin or element 90 is provided at the outer end portion of rod 32 to prevent the component parts of the clamp from being disassembled.

Figure 5:
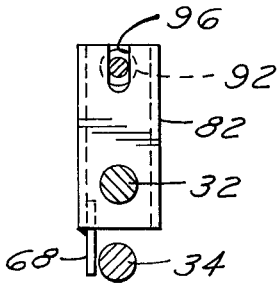
FIG. 5 is a sectional view taken on the line 5—5 of FIG. 3.

The releasable fastening means 80 also includes a threaded member 92 which is threadedly received in the threaded opening 86 and is carried by the bracket 82. The threaded member 92 is cut away near but spaced from the leading end thereof to form an annular notch 94. The upper end of end wall 60 of the second clamping member 54 is provided with an upwardly opening notch or opening 96 (FIG. 5) which receives the notched end of the threaded member 92. The trailing end of the threaded member 92 is provided in an operating handle 96 for clamping the unit together after the skis have been placed in the clamping sections and the clamping members 38 and 54 adjusted along the rod 32 and 34.

Manually operated means 100 are secured to mounting rod 22 and includes a plate or bracket 102 having a threaded hole 104 and a non-threaded generaly smooth hole 106 which are spaced apart. The rod 22 extends through the non-threaded opening 106 whereby the bracket 102 is freely movable or slidable along the rod during the adjustment of the manually operated means 100. Such means include a threaded element or member 108 which is threadedly received in the threaded opening 104 in bracket 102. The leading end of element 108 is provided with a support engaging abutment or disc 110 having a resilient pad 112 thereon engageable with the lower surface of the support 14 as shown in FIGS. 3 and 6. The trailing end of the threaded member 108 is provided with an operating handle 114. A stop pin or abutment 116 holds the bracket 102 on rod 22.

The resilient pads described herein may be made from rubber, felt or any other materials to prevent scatching or marking of the support 14 and the workpieces or skis S.

Each of the first and second clamping sections include a horiztonal area H and a vertical area A as shown only in FIG. 6.

Figure 1:
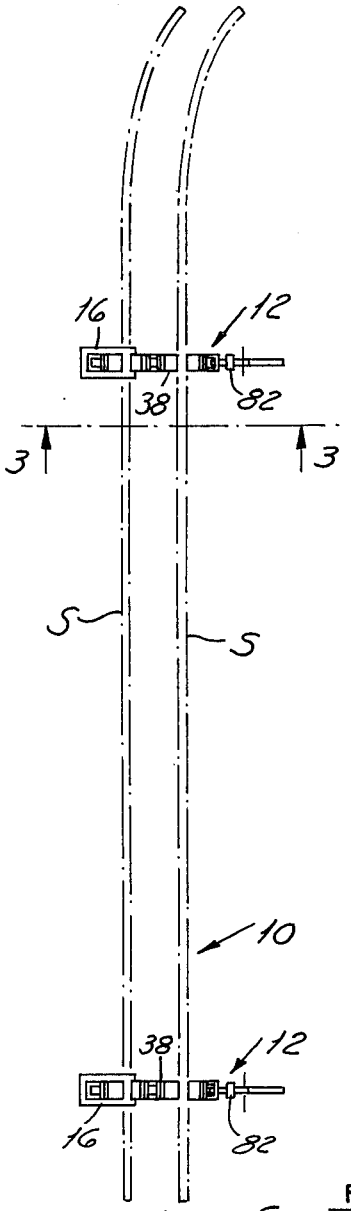
FIG. 1 is a plan view of a ski clamping apparatus having a pair of clamps spaced apart on a support, with the clamping sections of the clamps aligned and maintaining a pair of skis in parallel relation to permit the sharpening of the edges of the skis.
Figure 2:
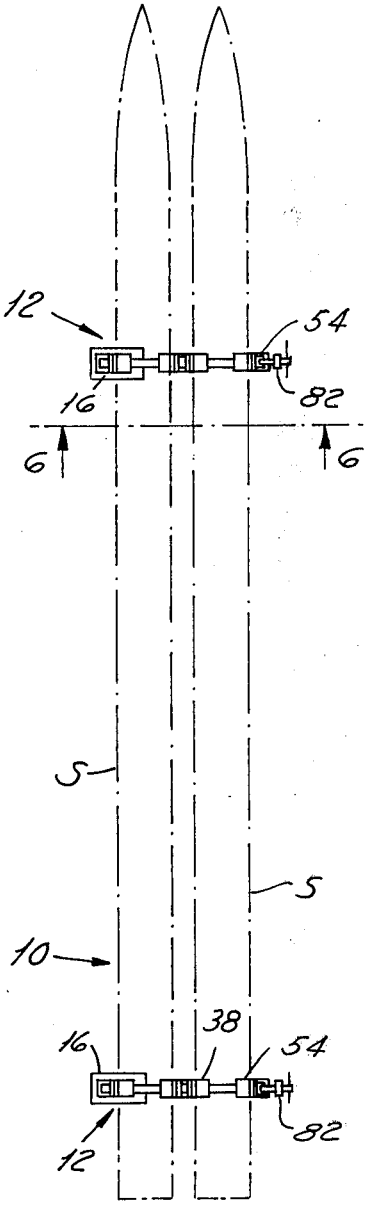
FIG. 2 is a plan view of a ski clamping apparatus having a pair of clamps spaced apart, with the clamping sections of the clamps aligned to hold portions of longitudinally extending edges of the skis, with the bottom surfaces of the skis facing upwardly.

In use, a skier utilizes a pair of clamps 12 with the top panel of a desk or drawer from which the top drawer is removed so that the clamps 12 can be appropriately mounted on the support 14 as described previously and in spaced relationship illustrated in FIGS. 1 and 2.

Each clamp 12 is of identical construction and thus when the clamps 12 are mounted on the support 14, spaced longitudinally apart, to form the apparatus 10, the areas H of the clamps 12 are horizontal and lie in the same horizontal plane as noted in FIG. 6. When it is required to flat file and wax the bottom of a pair of skis S, the clamps 12 are arranged as just described and in the manner illustrated in FIG. 2. Each ski S is placed between the cooperating flanges 28 and 50 and cooperating flanges 52 and 64, with the bottoms of the skis S facing upwardly. The clamping members 38 and 54 are moved toward the stationary clamping member 20 to take up any slack and to accommodate the skis S. Thereafter the actuating means 80 of each clamp 12 including the handle 96 is actuated so as to clamp the longitudinal edges of the skis S and thus hold the skis S in a fixed position as illustrated in FIGS. 2 and 6. The clamps 12 of apparatus 10 are operated independently.

After both of the skis S have been filed to remove burns, to obtain a sharp corner and then waxed, they are removed from the apparatus 10. When the bottom surfaces of both skis S have been filed and waxed, it is then necessary to file the edges of the skis S to insure right angle sharpening. This operation is accomplished by utilizing the vertical areas V of the first and second clamping sections. The skis S are placed on the longitudinal edges as noted in FIGS. 1 and 3 with one ski in a clamping section. The skis S are held at the same height or elevation by surfaces of the upper mounting element or rod 32 as noted in FIG. 3. A file is moved across the upper longitudinal edges of the skis S, with the file maintained at 90° to insure right angle sharpening of the skis S simultaneously. After the upper edges of the skis S have been filed, the skis S are removed from the appratus 10 and then reinserted in the clamps 12 with the other edges of the skis S facing upwardly for subsequent edge filling as is well known in the art.

It should be noted that the first movable clamping member 38 slides freely on both rods 32 and 34. The second movable clamping member 54 is addition to sliding on rod 32 can also rotate in one direction to assist in adjusting the member 54 along rod 32. Once the clamping member 54 is near its adjusted position on rod 32, the clamping member 54 is rotated to urge the depending flange 68 into engagement with rod 34 thereby aligning the clamping member 54 with the other clamping members 20 and 38.

With the present invention, a skier can tune the skis to his or her personal and exacting requirements. The clamps can be mounted on most any flat surface to permit flat filing, waxing, scraping, polishing and edge filing of the skis. FIG. 6 shows the bottoms of a pair of skis S facing upwardly for waxing same. When it is required to file the edges of the skis, only one ski S is placed in the horizontal section H between the stationary clamping member 20 and the first clamping member 30. The second ski is removed from the other horizontal section H and thereafter the second movable clamping member 54 is rotated (so that it will be out of the way when filing one ski) and moved to the left as viewed in FIG. 6 and abuts or hits against the first clamping member 30. Thereafter the releasable fastening means 80 is actuated to fasten the single ski S between members 20 and 38. In such a case the second movable clamping member 54 is, as an example, at a 45° angle from the position shown in FIG. 6 and thus does not interfere with the filing operation.

FIG. 1 shows a pair of skis S arranged in the clamping apparatus 10 whereby the left hand sides of the skis S can be filed. The operator is at the left side of the appratus 10 as viewed in FIG. 1, with the skis curving away from the operator. When completed, both skis S are turned 180° or flopped over, with the curved ends of the skis at the bottom of the drawing as viewed in FIG. 1. The operator remains at the left side as viewed in FIG. 1, with the skis curving away from the operator. Thereafter the right hand sides of the skis S are filed. The burrs caused by the filing operation will be turned up on both skis S; are not required to be removed; and will not interfere when skiing.

I claim:

1. A clamp adapted to be mounted on a support comprising a support flange, a stationary clamping member secured to said support flange, a first elongated mounting element secured to and extending to one direction from said stationary clamping member, a first movable clamping member provided with an opening through which said elongated mounting element extends, each of said stationary and first clamping members having a first abutment, the first abutment on said stationary clamping member cooperating with the first abutment on said first clamping member to form a first clamping section for supporting a workpiece, said first clamping member being movable on said first mounting element towards or away from said stationary clamping member to clamp the workpiece between said first abutments or to release the workpiece from between the first abutments, a second movable clamping member provided with an opening through which said first mounting element extends, said first clamping member being located between said stationary clamping member and said second movable clamping member, each of said first and second clamping members having a second abutment, the second abutment on said first clamping member cooperating with the second abutment on said second clamping member to form a second clamping section for supporting another workpiece, said second clamping member being movable on said mounting element towards or away from said first clamping member to clamp the workpiece between said second abutments or to release the workpiece from between said second abutments, and releasable fastening means carried by said mounting element engageable with said second clamping member for maintaining the workpieces between the cooperating abutments of said first and second clamping sections, said releasable fastening means including a locking bracket having a pair of openings, with one bracket opening being threaded and the other bracket opening being non-threaded, with the non-threaded opening of the locking bracket being sleeved over said first mounting element whereby said bracket is freely movable along said first mounting element during adjustment of said releasable fastening means, said releasable fastening means including aa threaded member which is threadedly received in said threaded opening in said bracket, said second clamping member including an opening which receives and carries one end portion of said threaded member and the other end portion thereof being provided with a handle for rotating said threaded member.

2. The clamp defined in claim 1 wherein a second elongted mounting element is fixedly provided which is secured to and extends from said stationary clamping member in the same direction as said first mounting element, said first clamping member having another opening through which said second mounting element extends.

3. The clamp defined in claim 2 wherein said first and second elongated mounting elements are each of cylindrical configuration, with the axes thereof parallel and spaced apart.

4. The clamp defined in claim 1 wherein each of said clamping members are of tubular construction, with each abutment extending along the top and one of the sides of the corresponding clamping member.

5. The clamp defined in claim 2 wherein said second clamping member is provided with a depending flange engageable with said second mounting element for aligning said second abutments.

6. The clamp defined in claim 5 wherein the surfaces of said support flange, said movable support engaging abutment and said first and second abutments are provided with resilient pads to prevent scratching or marking of the support and the workpieces.

7. A ski clamp for holding a pair of skis and adapted to be mounted on a support comprising a support flange extending in one direction, a stationary clamping member fixedly secured to said support flange, a pair of spaced apart and parallel elongated mounting elements at one side of and spaced from said support flange, said mounting elements being fixedly secured to said stationary clamping member and extending in said one direction, a first movable clamping member provided with a pair of openings through which said elongated mounting elements extend, each of said stationary and first clamping members having a first abutment, the first abutment, the first abutment on said stationary clamping member cooperating with the first abutment on said first clamping member to form a first clamping section for supporting a ski, said first clamping member being movable on said mounting elements towards or away from said stationary clamping member to clamp the ski between said first abutments or to release the ski from between the first abutments, a second movable clamping member provided with a single opening through which one of said mounting elements extend, the other of said mounting elements being located between said one mounting element and said support flange, each of said first and second clamping members having a second abutment, the second abutment on said first clamping member cooperating with the second abutment on said second clamping member to form a second clamping section for supporting another ski, said second clamping member being movable on said one mounting element towards or away from said first clamping member to clamp the ski between said second abutments or to release the ski from between said second abutments, a flange depending from said second movable clamping member engageable with said other mounting element for aligning said second abutments, and releasable fastening means carried by said one mounting element engageable with said second clamping member for maintaining the pair of skis between the cooperating abutments of said first and second clamping sections.

8. The ski clamp defined in claim 7 wherein said pair of elongated mounting elements are in the form of rods of cylindrical configuration.

9. The ski clamp defined in claim 7 wherein each of said clamping members are of tubular construction, with each abutment extending along the top and one of the sides of the corresponding clamping member.

10. The ski clamp defined in claim 7 wherein an alongated rod is secured to said support flange on the side thereof opposite to said stationary clamping member, and manually operated means carried by said rod, said manually operated means including a movable support engaging abutment which cooperates with said support flange for mounting the clamp on a support.

11. The ski clamp defined in claim 10 wherein said manually operated means includes a bracket having a pair of openings, with one opening being threaded and the other opening being non-threaded, with said rod extending through the non-threaded opening of the bracket whereby the bracket is freely movable along the rod during adjustment of the manually operated means, said manually operated means including a threaded element which is threadedly received in said threaded opening in said bracket, one end of said threaded element being provided with said movable support engaging abutment and the other end being provided with a handle for rotating said threaded element and positioning said movable support engaging abutment relative to the support.

12. The ski clamp defined in claim 11 wherein the surfaces of said support flange, said movable support engaging abutment and said first and second abutments are provided with resilient pads to prevent scratching or marking of the support and the skis.

13. The ski clamp defined in claim 7 wherein said releasable fastening means includes a locking bracket having a pair of openings, with one opening being threaded and the other opening being non-threaded, with the non-threaded opening of the locking bracket being sleeved over said one mounting element whereby the bracket is freely movable along said one mounting element during adjustment of said releasable fastening means, said releasable fastening means including a threaded member which is threadedly received in said threaded opening in said locking bracket, said second clamping member including an opening which receives and carries one end portion of said threaded member and the other end portion thereof being provided with a handle for rotating said threaded member.

14. A ski clamping apparatus for holding a pair of skis and adapted to be mounted on a support, said apparatus comprising a pair of clamps of identical construction, said clamps being spaced apart on the support and adapted to hold different portions of each ski, each clamp comprising a support flange extending in one direction, a stationary clamping member fixedly secured to said support flange, a pair of spaced apart and parallel elongated mounting elements at one side of and spaced from said support flange, said mounting elements being fixedly secured to said stationary clamping member and extending in said one direction, a first movable clamping member provided with a pair of openings through which said elongated mounting elements extend, each of said stationary and first clamping members having a first abutment, the first abutment on said stationary clamping member cooperating with the first abutment on said first clamping member to form a first clamping section for supporting a ski, said first clamping member being movable on said mounting elements towards or away from said stationary clamping member to clamp the ski between said first abutments or to release the ski from between the first abutments, a second movable clamping member provided with a single opening through which one of said mounting elements extend, the other of said mounting elements being located between said one mounting element and said support flange, each of said first and second clamping members having a second abutment, the second abutment on said first clamping member cooperating with the second abutment on said second clamping section for supporting another ski, said second clamping member being movable on said one mounting element towards or away from said first clamping member to clamp the ski between said second abutments or to release the ski from between said second abutments, a flange depending from said second movable clamping member engageable with said other mounting element for aligning said second abutments, the first and second clamping sections of one clamp being respectively longitudinally aligned with the first and second clamping sections of the other clamp, and releasable fastening means for each clamp carried by said one mounting element engageable with said second clamping member for maintaining the pair of skis between the cooperating abutments of said first and second clamping sections of each of said clamps.

* * * * *